United States Patent [19]

Haacker et al.

[11] Patent Number: 4,765,399

[45] Date of Patent: Aug. 23, 1988

[54] METHOD AND PLANT FOR THE CONDENSATION OF EXCESS STEAM

[75] Inventors: Ingo Haacker, Unna; Friedhelm Landgräber, Dortmund, both of Fed. Rep. of Germany

[73] Assignee: Uhde GmbH, Dortmund, Fed. Rep. of Germany

[21] Appl. No.: 802,759

[22] Filed: Nov. 27, 1985

[30] Foreign Application Priority Data

Nov. 30, 1984 [DE] Fed. Rep. of Germany ..... 3443762

[51] Int. Cl.[4] ..... F28B 1/00; F01K 9/02; F22D 11/06

[52] U.S. Cl. ..... 165/110; 165/71; 60/690

[58] Field of Search ..... 165/71, 110, 122; 60/692, 690

[56] References Cited

U.S. PATENT DOCUMENTS

| | | | |
|---|---|---|---|
| 3,519,068 | 7/1970 | Harris et al. | 165/122 X |
| 3,885,620 | 5/1975 | Von Cleve | 165/71 |
| 4,090,557 | 5/1978 | Currier | 165/110 |
| 4,585,054 | 4/1986 | Köprunner | 60/692 X |
| 4,649,019 | 3/1987 | Jawor | 165/71 X |

FOREIGN PATENT DOCUMENTS

| | | | |
|---|---|---|---|
| 1241852 | 6/1967 | Fed. Rep. of Germany | 165/71 |

*Primary Examiner*—Ira S. Lazarus
*Assistant Examiner*—Peggy A. Neils
*Attorney, Agent, or Firm*—Toren, McGeady & Associates

[57] ABSTRACT

Referring to method and plant for the condensation of excess steam obtained from steam-producing and steam-consuming facilities it is intended to provide a solution which avoids the release of steam into the atmosphere and the absorption of oxygen by the condensate. The problem is solved by indirect heat-exchange in a condenser that is filled with an oxygen-free fluid which is displaced by the excess steam into a receiver, the fluid being returned to the condenser in the absence of an excess steam flow. Referring to the plant, the problem is solved in that a condensate receiver (5) with gas dome is arranged downstream of the condensate header (4) of condenser (2), a line (11) for condensate discharge being provided between condensate header (4) and condensate receiver (5) while a line (10) for the inert gas is connected to the gas dome (9).

8 Claims, 1 Drawing Sheet

METHOD AND PLANT FOR THE CONDENSATION OF EXCESS STEAM

Figure 1:
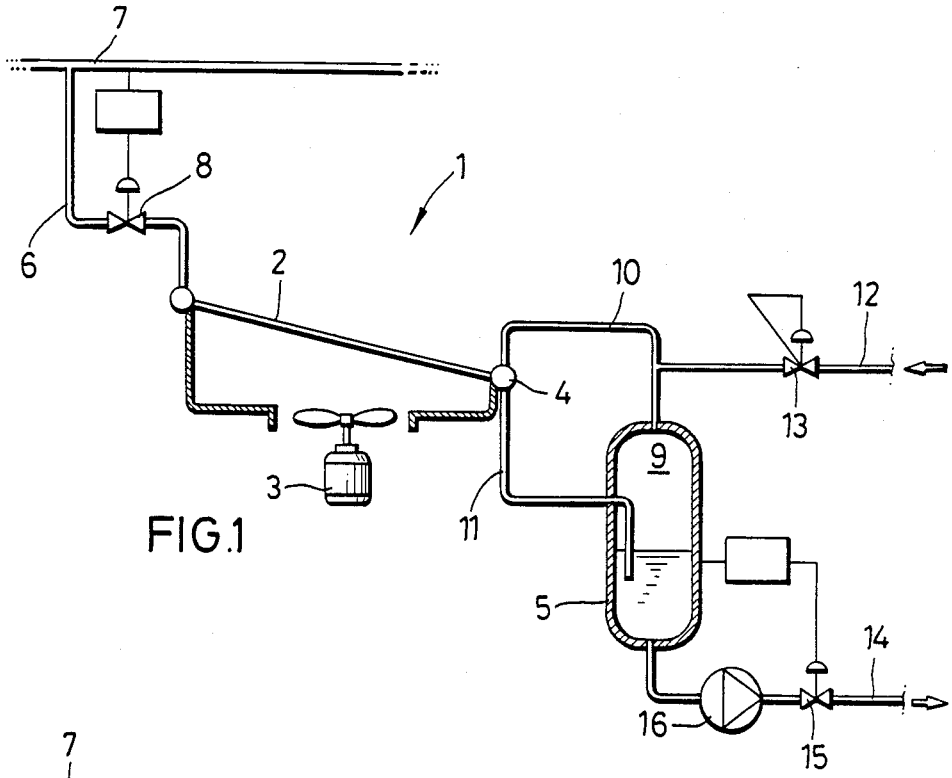

The invention relates to a method and plant for the condensation of excess steam obtained from steam-producing and steam-consuming facilities in a condenser designed for indirect heat-exchange.

Steam is needed for a great number of industrial operations apart from the utilisation of steam for heating purposes or for the production of energy through steam turbines. Excess steam, especially low-pressure steam, may temporarily be available in such steam systems without any possibility of utilizing it directly for heating purposes or as turbine live steam.

It is known to discharge excess steam to the atmosphere or to pass it to emergency condensers that are open to the atmosphere. It is also known to provide such emergency condensers with liquid discharge facilities.

A marked disadvantage inherent in releasing the steam to the atmosphere is, for example, the loss of water that has generally undergone expensive treatment; in addition, environmental conditions are adversely affected by noise and water vapour. When the steam passes through such emergency condensers, the condensate is liable to absorb oxygen from the atmosphere, which may cuse corrosion and entrainment of corrosion products into the steam system. It should be added that liquid discharge facilities of the condensers feature slow response so that they can be used within narrow limits only.

The object of the invention is to provide a method which avoids the release of steam to the atmosphere while preventing absorption of oxygen by the condensate.

For a method as defined above, the problem is solved according to the invention in that the condenser is filled with an oxygen-free fluid which is displaced by the excess steam into a receiver and is allowed to return into the condenser in the absence of excess steam.

Condensation of the excess steam by indirect heat-exchange avoids environmental pollution because the steam remains within the system. Since the condenser system, which is needed temporarily only, is filled with an oxygen-free fluid, no oxygen-bearing condensate goes into the process water. The specific requirements are satisfied by a multitude of fluids, i.e. they must permit to be displaced by water and steam and must be free of oxygen. Light-weight fluids will generally be preferred.

Although the method according to the invention is not restricted to the use of a specific fluid, it has been found that an inert gas, especially nitrogen, is particularly recommended.

It was mentioned before that the requirements are satisfied by a multitude of fluids, for example by industrial oils, which must be displaced into special receivers. But the use of an inert gas is particularly indicated because gases are compressible.

The invention also provides for the condenser to be equipped with a downstream condensate receiver with gas dome which serves for accommodating the inert gas and for its compression, if any. This embodiment has the advantage that displacement of the inert gas from the condenser into the gas dome produces a pressure rise which causes an early reflux of the inert gas into the condenser when the volume of condensate is reduced or the flow of excess steam is stopped. This procedure facilitates the flow control and shortens the response periods of the system.

The invention also provides for a plant for solving the subject problem, said plant being characterized in that a condensate receiver with gas dome is arranged downstream of the condenser condensate header, a condensate discharge line being arranged between condensate header and condensate receiver while the gas dome is provided with an inert gas line.

This solution which is particularly intended for the use of inert gas offers the advantage of quick response, simple design, economical operation, and a great variety of applications.

A further embodiment of the invention provides for the gas dome with connecting line to the condensate header to be sized for accommodating the entire inert gas volume contained in the condenser.

This embodiment permits the maximum working pressure to be achieved at full admission of steam to the condenser. The elevated pressure is markedly higher than the working pressure prevailing in open condensers, that is the atmospheric pressure. The elevated pressure level raises the condensation temperature of the steam and, consequently, the mean logarithmic temperature difference, so that less heat-exchange surface is required as compared with atmospheric condensers.

Considering that no oxygen corrosion can occur in the condensate system, inexpensive piping materials may be selected for the service conditions involved.

The invention may be described in more details with reference to the drawings.

FIG. 1: typical arrangement of a plant according to an embodiment of the invention.

Figure 2:
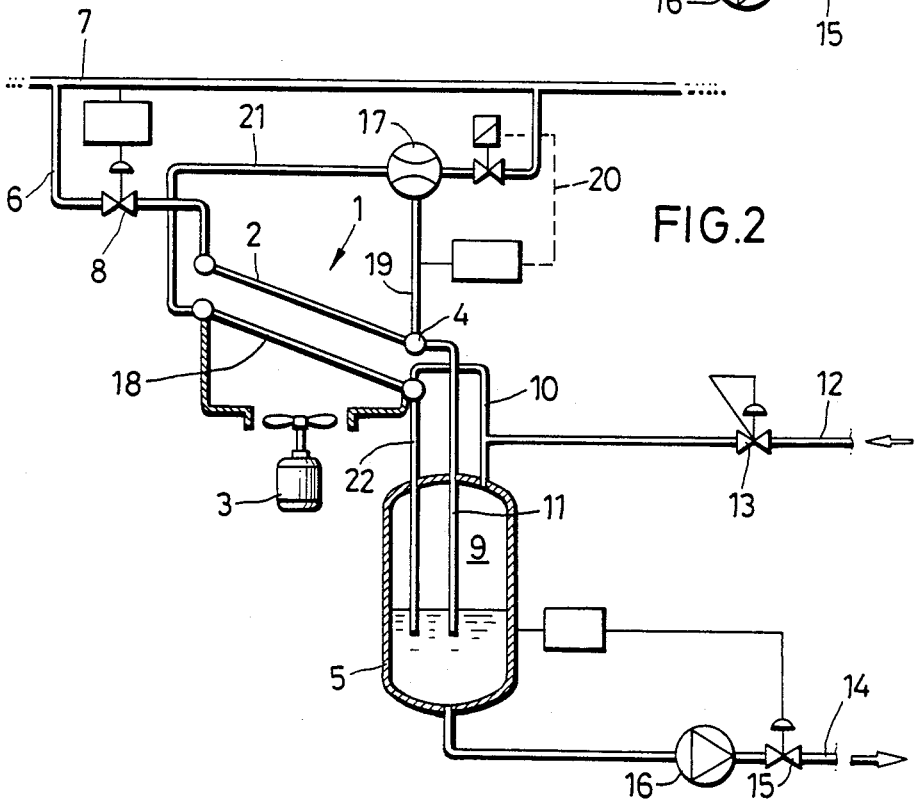

FIG. 2: typical arrangement of a plant according to a different embodiment.

The plant designated by 1 comprises an air-cooled condenser 2 of shed-roof design. The blower is designated by 3. It should be said that all plant components are shown schematically only.

Condenser 2 is provided with a condensate header 4, with a condensate receiver 5 being arranged downstream in the direction of condensate flow.

Excess steam is admitted to the condenser through line 6 which branches off the mains 7 and is equipped with control facilities 8.

The Figure shows that condensate receiver 5 is equipped with a gas dome 9. Provision is made for an inert gas line 10 between gas dome 9 and the top of condensate header 4 and for a condensate discharge line 11 connected to the bottom of condensate header 4.

FIG. 1 also shows an inert gas feed line 12 with control facilities 13 and a condensate reflux line 14 with control facilities 15 and a pump 16.

Operation of the plant may be described as follows:

Excess steam from mains 7, for example the low-pressure steam system, is admitted through line 6 and control station 8 to condenser 2. Under no-load conditions, this condenser 2 is completely filled with a fluid, for example nitrogen. The incoming excess steam displaces this nitrogen from the system into the gas dome of condensate receiver 5. The nitrogen is displaced through line 10 while the condensate is admitted throough line 11 to condensate receiver 5. The condensate is finally returned through pump 16 and line 14.

As soon as no further excess steam arrives from system 7, valve 8 moves into the closed position, and the condensate leaves the system. The elevated pressure produced by the displacement of the nitrogen into gas dome 9 will immediately force the nitrogen through line 10 and condensate header 4 back into the condenser. This procedure prevents oxygen to contact the condensate at any point of the system.

Referring to FIG. 2, the plant incorporates an ejector 17 with a downstream cooler 18.

For reducing the heat-exchange surface, this design provides for the inert gas to be withdrawn through ejector 17 for admission to a separate section of the heat exchanger. This method is applied to raise the flow velocity in the heat-exchanger tubes and the heat transfer rate.

The plant designated by 1 as in FIG. 1 is also equipped with an air-cooled condenser 2 of shed-roof construction. In addition, it comprises the ejector 17 and a separate aftercooling section 18. Excess steam from line 7 passes through line 6 and control valve 8 into condenser 2.

Condensate flows through downpipe 11 into condensate receiver 9. Displaced inert gas passes through line 19 to ejector 17.

As the pressure rises in line 19, steam arrives at ejector 17, and the inert gas passes through line 21 to the aftercooling section 18; the inert gas is cooled, motive steam and water vapour undergo condensation. The condensate flows through a downpipe 22 into the condensate receiver while the inert gas passes through connecting line 10 into the gas dome.

The water level which builds up in downpipe 11 depends on the pressure difference between condensate pipe or condenser 2 and aftercooling section 18.

The embodiments of the invention, referring to method and plant, described before by way of example permit, of course, a plurality of modifications without deviating from the basic idea of the disclosure. Provisions may be made, for example, for an additional inert gas control station or facilities which prevent excessive diffusion of inert gas into the process water, etc. If, for example, oil is used instead of gas, pressure equalizing vessels may be recommended. Moreover, condensers may be used which are designed for being cooled with water or any other fluid. If a water-cooled condenser is used instead of the air-cooled condenser it is recommended, for the arrangement described above, to admit the steam to the tubeside and the cooling fluid to the shellside in order to achieve a distinct flow and displacement of the inert gas.

What is claimed:

1. Method for avoiding the flow of steam into the atmosphere by the condensation of excess steam from a mains obtained steam from steam-producing and steam-consuming facilities, in a condenser connected to the mains by control facilities and designed for indirect heat-exchange and for preventing the absorption of oxygen by the condensate, the condenser having a no-load condition free of steam from the mains and a load condition where it receives steam from the mains comprising the steps of filling the condenser with an oxygen-free fluid in the no-load condition of the condenser for maintaining the condenser free of oxygen, in the load condition for displacing the oxygen-free fluid from the condenser by flowing the excess steam from the mains through the control facilities into the condenser while flowing steam through the mains, collecting the displaced oxygen-free fluid in a receiver in direct flow communication with the condenser and pressurizing the oxygen-free fluid within the receiver based on the amount of flow of the oxygen-free fluid received therein from the condenser, condensing the excess steam in the condenser and flowing the condensate from the condenser into the receiver, due to the pressurization of the oxygen-free fluid within the receiver returning the oxygen-free fluid directly from the receiver to the condenser in the absence of excess steam flow into the condenser and returning the condensate from the receiver to the steam-producing and steam-consuming facilities.

2. Method according to claim 1, wherein using an oxygen-free inert gas as the fluid for filling the condenser.

3. Method according to claim 2, wherein using nitrogen as the oxygen-free inert gas.

4. Method according to any one of the preceding claims, wherein arranging a gas dome in the condensate receiver downstream of the condenser, with the gas dome serving for accommodating the oxygen-free fluid at atmospheric pressure or at an elevated pressure.

5. Plant for avoiding the flow of steam into the atmosphere by the condensation of excess steam received from steam-producing and steam-consuming facilities and for preventing the absorption of oxygen by the condensate comprising a condenser maintained free of access by the atmosphere and including a header for collecting condensate therein, said condenser operating under indirect heat exchange with excess steam passing therethrough, a condensate receiver (5) including a gas dome (9) therein, a condensate discharge line (11) connecting said condenser header and said condensate receiver for providing direct unimpeded flow of condensate from said condenser to said condensate receiver, means for filling said condenser with an oxygen-free fluid including a line (10) separate from said discharge line (11) and directly connecting said condenser header and said gas dome in said condensate receiver for the unimpeded flow of the oxygen-free fluid therebetween, a mains obtaining steam from a steam-producing and steam-consuming facilities, means for controlling the supply of steam from said mains into said condenser, and means for returning condensate from said condenser receiver to said steam-producing and steam-consuming facilities whereby said condenser can be filled with the oxygen-free fluid and when excess steam is passed into said condenser the oxygen-free fluid is displaced into and pressurized within the gas dome in said condensate receiver and in the absence of excess steam flowing into said condenser, due to the pressurization thereof the oxygen-free fluid flows unimpeded back from the gas dome into said condenser.

6. Plant, as set forth in claim 5, wherein said gas dome (9) with said line (10) is sized for accommodating the entire volume of the oxygen-free fluid contained within said condenser (2).

7. Plant, as set forth in claim 5, wherein said oxygen-free fluid is an oxygen-free inert gas.

8. Plant, as set forth in claim 7, wherein said oxygen-free inert gas is nitrogen.

* * * * *